United States Patent [19]

Frentrup et al.

[11] Patent Number: 4,746,450

[45] Date of Patent: May 24, 1988

[54] FUNCTIONAL FLUIDS AND CONCENTRATES THICKENED WITH ASSOCIATIVE POLYETHER THICKENERS CONTAINING CERTAIN PRIMARY AMINES

[75] Inventors: Mark A. Frentrup, Redford; Stanley T. Hirozawa, Birmingham; Charles F. Deck, Trenton, all of Mich.

[73] Assignee: BASF Corporation, Parsippany, N.J.

[21] Appl. No.: 939,352

[22] Filed: Dec. 8, 1986

[51] Int. Cl.[4] ..... C10M 173/02; C10M 119/18; C10M 137/06

[52] U.S. Cl. ..... 252/75; 252/32.7 E; 252/46.4; 252/46.7; 252/49.3; 252/74; 252/78.5

[58] Field of Search ..... 252/32.7 E, 46.4, 46.7, 252/49.3, 74, 75, 78.5

[56] References Cited

U.S. PATENT DOCUMENTS

| | | | |
|---|---|---|---|
| 3,396,109 | 8/1968 | Butler et al. | 252/75 |
| 4,253,975 | 3/1981 | Law et al. | 252/75 |
| 4,481,125 | 11/1984 | Holgado | 252/75 |
| 4,486,324 | 12/1984 | Korosec | 252/75 |

*Primary Examiner*—Robert Wax

*Attorney, Agent, or Firm*—John C. Demeter; Bernhard R. Swick

[57] ABSTRACT

This invention relates to water based functional fluids and antiwear compositions for such functional fluids. The functional fluids can be used in hydraulic systems or as metal working compositions to cool and lubricate surfaces which are in frictional contact during operations such as the turning, cutting, peeling, or grinding of metals. More specifically, the invention relates to a novel antiwear composition for inclusion in functional fluids which comprises:

(a) a metal dialkyldithiophosphate, and (b) certain primary amines.

It has been found that this combination of certain primary amines with the metal dialkyldithiophosphate provides improved wear properties over the use of the metal dialkyldithiophosphate alone, particularly at higher operating pressures such as 2000 psig and above. The functional fluid would also contain (c) a thickener and optionally (d) a carboxylic compound; and (e) a surfactant.

20 Claims, No Drawings

FUNCTIONAL FLUIDS AND CONCENTRATES THICKENED WITH ASSOCIATIVE POLYETHER THICKENERS CONTAINING CERTAIN PRIMARY AMINES

BACKGROUND OF THE INVENTION

This invention relates to thickened functional fluids characterized by substantially improved wear properties.

It is known that antiwear additives such as zinc dialkyldithiophosphates reduce wear in thickened high-water hydraulic fluids. See for example U.S. Pat. No. 4,481,125. These fluids, however, are limited in their ability to operate in equipment, such as vane pumps, at pressures above 1,000 psi.

New associative thickeners have been developed that can be used to prepare high-water hydraulic fluids which will operate in vane pumps at pressures greater than 2,000 psi. The problem is that the wear rate at these pressures is too high (generally more than 8 mg/hr) even though the fluids contain a traditionally used antiwear additive such as a zinc dialkydithiophosphate.

The instant specification discloses that the addition of certain primary amine compounds will significantly reduce the wear rate.

British Pat. No. 1,409,157 discloses reacting a metal dialkyl dithiophosphate with an amine. However, the British patent relates to a completely non-analogous art, namely, vulcanization of synthetic elastomers and has nothing to do with functional fluids.

One group of useful primary amines is disclosed in U.S. Pat. No. 4,313,004. This patent describes certain diaminoalkoxy compounds having the following structural formula:

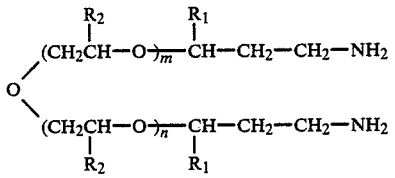

wherein m and n are both numbers from 0 to about 25 and m+n equals at least 1 and $R_1$ is selected from H and a lower alkyl group having from 1 to about 4 carbon atoms and $R_2$ is selected from H and an alkyl group containing from 1 to 10 carbon atoms.

At column 6, lines 9–10, the patent indicates that these compounds are generally used as epoxy curing agents. Other uses for the compounds are listed at column 6, lines 9–19, of the patent. It is disclosed that they can be used as oil and fuel adductive intermediates; for the formation of diisocyanate compositions; and to form polyamides. The patent, however, does not teach or suggest that such compounds can be used to reduce the wear rate of thickened hydraulic fluids which contain an antiwear additive.

SUMMARY OF THE INVENTION

This invention relates to functional fluids which can be used in hydraulic systems or as metalworking compositions to cool and lubricate surfaces which are in frictional contact during operation such as the turning, cutting, peeling, or the grinding of metals. More particularly, the invention is directed to an antiwear combination or composition and to a water base functional fluid composition containing:

A. a metal dialkyldithiophosphate having the following structural formulae:

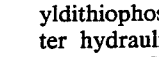

(I)

wherein each R is individually linear or branched alkyl, alkenyl, aryl, arylalkyl, or alkylaryl groups having from 3 to 24 carbon atoms, preferably 3 to 16;

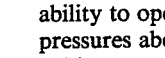

(II)

wherein each R is individually a linear or branched alkyl, alkenyl, aryl, arylalkyl, or alkylaryl group having from 3 to 24 carbon atoms, preferably 3 to 16 and B. a primary amine selected from the group consisting of compounds having the following structural formulae:

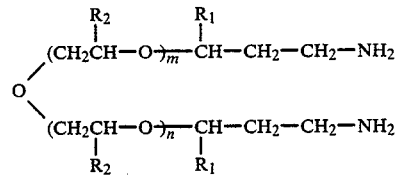

(III)

wherein m and n are both numbers from 0 to about 25 and m+n equals at least 1 and $R_1$ and $R_2$ are independently selected from H and a lower alkyl group having from 1 to about 4 carbon atoms;

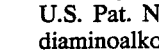

(IV)

wherein R is an alkoxy group and n is 2 to 4;

(V)

where R is an alkylene group having from 2 to 8 carbon atoms; and

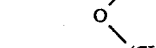

(VI)

wherein R is an alkylene group having from 3–6 carbon atoms; wherein the weight ratio of A:B is about 1:0.1 to 1:5.

The thickened functional fluid compositon would also include

C. about 1.0 to 15 percent by weight of a conventional thickener, said percentages based on the weight of the finished functional fluid.

Optionally and preferably the functional fluid composition would also include

D. from about 0.1 to 5.0 percent by weight carboxylic compound, said percentages being based upon the weight of the finished functional fluid; and Also optionally and preferably the functional fluid would include E. about 0.5 to 10 percent by weight of a surfactant, said percentage being based on the weight of the finished functional fluid.

To produce the finished fluid the above composition is diluted with water such that approximately 60 to 99 percent of the fluid will consist of water. Alternatively, some or all of the water of dilution may be replaced by a freezing point lowering additive such as ethylene glycol, propylene glycol, butylene glycol, diethylene glycol, dipropylene glycol, triethylene glycol, tetraethylene glycol, and the like, or mixtures thereof.

Other conventional functional fluid additives may also be included. As used herein the expression "finished fluid" means a fluid diluted with water so that the concentration of additives are appropriate to the application for which the fluid was intended.

The inclusion of the specified primary amine compound in a hydraulic fluid reduces the wear rate of the fluid, particularly when operating in a hydraulic pump at higher pressures such as 2000 psig.

DESCRIPTION OF THE PREFERRED EMBODIMENTS

Metal dialkyldithiophosphates which can be used are those having the following chemical structure:

$$Zn[(RO)_2PS_2]_2 \quad \text{(I)}$$

wherein each R is individually linear or branched alkyl. alkenyl. aryl, arylalkyl, or alkylaryl groups having from 3 to 24 carbon atoms. preferably 3 to 16. These additives are well known in the art. Also used are basic zinc salts having an emperical formula which is represented by $$Zn_4[(RO)_2PS_2]_6O, \quad \text{(II)}$$

wherein each R is individually a linear or branched alkyl, alkenyl, aryl, arylakyl, or alkylaryl group having from 3 to 24 carbon atoms, preferably 3 to 16.

There are several types of primary amines which are used to improve the wear of the hydraulic fluid, particularly at higher pressures of operation. One group can be represented by the following formula:

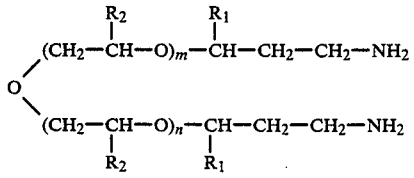

(III)

wherein m and n are both numbers from 0 to about 25 and m+n equals at least 1, and $R_1$ and $R_2$ are independently selected from H and a lower alkyl group having from 1 to about 4 carbon atoms. These compounds and a method for their preparation are clearly described in U.S. Pat. No. 4,313,004, which is hereby incorporated by reference into this specification. Examples include 4,7,10-trioxatridecane-1,13-diamine and 4,7-dioxadecane-1,10-diamine.

Another group of primary amines which can be used in the subject invention are represented by the following structural formula:

$$R(CH_2)_n\text{-}NH_2 \quad \text{(IV)}$$

wherein R is an alkoxy group having from 1 to 4 carbon atoms and n is a whole number from 2 to 4. Examples of such primary amines include methoxyethyl amine and ethoxyethyl amine.

Another group of primary amines which can be used to practice the subject invention are represented by the following structural formula:

$$R(OCH_2CH_2CH_2NH_2)_2 \quad \text{(V)}$$

wherein R is alkylene group having from 2 to 4 carbon atoms. These compounds can be prepared by reaction between the appropriate mono-, di-, or polyalkylene compound and acrylonitrile followed by hydrogenation of the nitrile to amine function.

The final group of compounds is represented by the formula $$H_2NRNH_2 \quad \text{(VI)}$$

where R is an alkylene group containing 3-4 carbon atoms. Examples include 1-3-diaminopropane and 1,4 diaminobutane.

The zinc dialkyldithiodiphosphate and primary amine can be added separately when making a hydraulic fluid, or they can be premixed or prereacted to form a complex before adding them to the hydraulic fluid. In any event, the weight ratio of said metal dialkyldithiophosphate primary amine is from about 1:0.1 to 1:5.

The thickeners, which are generally included in the functional fluids according to the invention, can be of the polyglycol type. The polyglycol thickeners are well known in the art and are polyoxyalkylene polyols, having a molecular weight of about 1,000 to 100,000, prepared by reacting an alkylene oxide with a linear or branched chain polyhydric alcohol. Suitable polyols are prepared from ethylene oxide and propylene oxide in a mole ratio of between about 100:0 to about 70:30 ethylene oxide:propylene oxide. Such thickeners are commercially available, and, for example, are sold under the trademark "Ucon 75H-90,000" by Union Carbide Corporation. The specifications for this commercial material call for a pour point of 40° F., a flash poiht of 485° F., a specific gravity at 20° C. of approximately 1.1 and a viscosity of about 90,000 SUS at a temperature of 100° F.

Preferred polyether polyol thickeners utilized to thicken the hydraulic fluids of the invention can be obtained by modifying a conventional polyether polyol thickening agent with an alpha olefin epoxide having an average of about 6 to 24 carbon atoms or mixtures thereof.

The conventional polyether polyols used to prepare these associative polyether thickeners are well known in the art. Essentially they are prepared by reacting an initiator, having at least two active hydrogen atoms, with one or more epoxides having from 2 to 4 carbon atoms, in the presence of an oxyalkylation catalyst at increased temperatures and pressures according to techniques well known in the art, such as those described in U.S. Pat. Nos. 4,411,819 and 4,288,639 which are hereby incorporated by reference into this specification. The particular conventional polyether polyol selected naturally will vary depending upon the use. It may be a homopolymer (preferably based upon ethylene oxide), a block copolymer (preferably with an internal ethylene oxide segment), or a heteric copolymer. These terms are familiar in the art and need no further explanation. The heteric copolymers are generally preferred because they are liquid at ambient temperatures.

The alpha-olefin epoxides which are reacted with the conventional polyether polyols to prepare the subject synthetic polyether thickeners have an average of from 6 to 24 total carbon atoms. They are well known in the art and are commercially available under the trademark VIKOLOX.

The reaction between the conventional polyether polyol and the alpha-olefin epoxide can be carried out according to the methods described previously for the preparation of the conventional polyether polyol. Essentially the conventional polyether polyol and alpha-olefin epoxide are reacted in the presence of an oxyalkylation catalyst at a temperature from about 50° C. to 150° C., preferably under an inert gas blanket from about 30 psig to 90 psig. The procedure is described in U.S. Pat. Nos. 4,411,819 and 4,288,639 mentioned previously.

More preferred are associative thickeners prepared by reacting a conventional polyether polyol with an alpha-olefin epoxide having an average of from 6 to 12 total carbon atoms such that (a) the reaction is carried out in the presence of an oxyalkylation catalyst at a temperature of from about 50° C. to about 150° C.; and
(b) an effective epoxide-to-hydroxyl ratio is used which will produce a thickener
  (i) which will have sufficient thickening efficiency to be used at less than ten percent weight concentration in an aqueous system; and
  (ii) which will produce thickened aqueous systems that will flow in a Vickers 104(C) vane pump at 2000 psig.

Mixtures or cogeneric mixtures of the described thickeners can also be used. It is also contemplated that mixtures or cogeneric mixtures of the subject thickeners and other synthetic thickeners, such as those described in U.S. Pat. No. 4,411,819, may be used for specific applications.

The molecular weight of the synthetic polyether thickener will vary over wide ranges and will depend upon the specific application. However, for most applications it will generally range from 1,000 to 100,000, and for most uses will vary from 5,000 to 50,000, generally from 10,000 to 40,000.

Other types of thickeners or viscosity increasing agents can be used in the hydraulic fluid and metal working compositions of the invention. Such materials are well known in the art and are utilized in varying proportions depending upon the desired viscosity and the efficiency of the thickening or viscosity increasing effect.

Generally, about 1.0 percent to 15.0 percent of such thickener is used based on the weight of the finished functional fluid.

Preferably the functional fluid compositions in accordance with this invention include phosphorus-free carboxylic compounds. These phosphorus-free carboxylic compounds are well known in the art and are disclosed in U.S. Pat. Nos. 4,368,133 and 4,481,125, which are hereby incorporated by reference into this application. Although a variety of such compounds are disclosed in these patents, generally preferred are reaction products of an alkenyl succinic anhydride and a dialkyl alkanolamine. The functional fluid preferably contains about 0.1 to 5.0 percent by weight, of the phosphorus-free carboxylic compound said percentages being based upon the weight of the finished functional fluid.

A surfactant, which has a minimum solubility of about 5 grams per liter in water at 20° C., preferably is also used in the functional fluid. Surfactants such as those described in U.S. Pat. No. 4,257,902 which is incorporated by reference into this specification may be employed. Although it is believed that any of these surfactants will work in the subject functional fluids, it is preferred to use polyether nonionic surfactants. These surfactants are prepared by reacting an alkylene oxide with an active hydrogen-containing compound to form a molecule having an average molecular weight of approximately 300 to 10,000, preferably 500 to 5000, and most preferably 500 to 2000, which contains a hydrophobe segment and a hydrophile segment. However, they do not contain a hydrophobe segment based upon an alpha-olefin epoxide or glycidyl ether addition as do the associative thickeners described previously in this specification.

Although other polyether nonionic surfactants may work satisfactorily, three groups of surfactants have been shown to work particularly well. The most preferred group consists of polyether nonionic surfactants prepared by reacting a preferably aliphatic alcohol, fatty acid, fatty acid amide, amine initiator (preferably an alcohol initiator) having about 8 to about 18 carbon atoms, preferably about 12 to about 15 carbon atoms, with ethylene oxide to prepare a homopolymer containing the residue of about 5 to about 100 moles of ethylene oxide. Preferably, about 5 to about 20 moles of ethylene oxide are reacted with the initiator to prepare said homopolymer polyether surfactants.

Alternatively, block or heteric copolymers can be prepared using as reactants ethylene oxide and a lower alkylene oxide, preferably having 3 to 4 carbon atoms. The residue of ethylene oxide in said polyether copolymer generally is at least about 70 percent by weight when the lower alkylene oxide used with ethylene oxide has 3 carbon atoms. The ethylene oxide residue in the polyether obtained generally is about 80 percent by weight when a lower alkylene oxide containing 4 carbon atoms is utilized with ethylene oxide in the preparation of the ethoxylated surfactant. Preferably, the average molecular weight of the surfactant is about 500 to about 2000. Representative aliphatic alcohol or amine initiators are octadecyl alcohol, stearyl amine, lauryl alcohol, lauryl amine, myristyl alcohol or amine, and cetyl alcohol or amine.

Another preferred group of polyether nonionic surfactants is ethoxylated alkyl phenols having 1 to about 20 carbon atoms in the alkyl group and preferably an average molecular weight of about 400 to about 2000. These are derived from the reaction of an alkyl phenol with ethylene oxide to produce a homopolymer. Alternatively, a block or heteric copolymer can be prepared by reacting ethylene oxide and a lower alkylene oxide, preferably having 3 to 4 carbon atoms, with an alkyl phenol. The alkyl phenol preferably has about 4 to about 20 carbon atoms in the alkyl group. Preferably, the ethoxylated alkyl phenols are derived from the reaction of said alkyl phenol with ethylene oxide or ethylene oxide and at least one lower alkylene oxide, preferably having 3 to 4 carbon atoms, provided that the ethoxylated polyether copolymer surfactant obtained thereby contains at least 60 percent to about 96 percent by weight of ethylene oxide residue. The ethoxylated homopolymer alkyl phenols contain the residue of about 5 to about 100 moles of ethylene oxide. Representative alkyl phenols useful in the preparation of alkoxylated alkyl phenol surfactants are octylphenol, nonylphenol, dodecylphenol, dioctyphenol, dinonylphenol, dodecylphenol and mixtures thereof.

The final group of preferred polyether nonionic surfactants consists of ethylene oxide adducts of sorbitol and sorbitan mono-, di-, and triesters having average molecular weights of 500 to 5000, preferably 500 to 2000. These surfactants are well known in the art. These surfactants are generally prepared by esterifying 1 to 3 moles of a fatty acid and then further reacting with ethylene oxide. The fatty acids usually contain from 10 to 20 carbon atoms, preferably 12 to 18 carbon atoms.

Alternatively, a block or heteric copolymer can be prepared by reacting ethylene oxide and a lower alkylene oxide, preferably having 3 to 4 carbon atoms with the fatty acid ester. Preferably the surfactants are prepared by the reaction of the ester with ethylene oxide or ethylene oxide and at least one lower alkylene oxide preferably having 3 to 4 carbon atoms provided that the ethoxylated polyether copolymer surfactant obtained thereby contains from about 20 percent to about 90 percent by weight of ethylene oxide residue. The ethoxylated homopolymers contain the residue of about 5 to about 100 moles of ethylene oxide. They are commercially sold under the INDUSTROL ® trademark. Particularly useful are INDUSTROL ® L20-S, INDUSTROL ® O20-S, INDUSTROL ® S20-S, INDUSTROL ® 68, and INDUSTROL ® 1186.

The functional fluid generally contains about 0.5 to about 10.0 percent of the surfactant based on the weight of the finished functional fluid.

The functional fluids may also contain various additives such as linear or branched alkanolamines having from 2 to 20 carbon atoms. Specific examples of alkanolamines which may be used include: monoethanolamine, diethanolamine, morpholine, triethanolamine, monoisopropanolamine, diisopropanolamine, triisopropanolamine, disec-butanolamine, sec-butylaminoethanol, dimethylethanolamine, diethylethanolamine, aminoethylethanolamine, methylethanolamine, butylethanolamine, phenylethanolamine, dibutylethanolamine, monoisopropylethanolamine, diisopropylethanolamine, phenylethylethanolamine, methyldiethanolamine, ethyldiethanolamine, phenyldiethanolamine, dimethylisopropanolamine, 2-amino-2-methyl-1-propanol, and 2-amino-2-ethyl-1,3-propanediol.

A metal deactivator may also be used in the subject concentrates and functional fluids. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolyltriazole, 2-mercaptobenzothiazole, sodium 2-mercaptobenzothiazole, and N,N'-disalicylidene-1,2-propanediamine.

The expression "finished functional fluid" includes such additives when present. The corrosion inhibitors and metal deactivators are generally used in amounts of from about 0.001 part to 5.0 parts by weight, preferably 0.001 part to 0.2 part by weight per 100 parts of the finished fluid.

The examples which follow will illustrate the practice of this invention in more detail and disclose the best mode for practicing it. However, they are not intended in any way to limit its scope, and it is contemplated that many equivalent embodiments of the invention will be operable.

The following abbreviations will be used in the examples:

| | |
|---|---|
| AP | 3-amino-(1-propanol) |
| BA | butylamine |
| CHA | cyclohexylamine |
| DAP | 1,3-diaminopropane |
| DIPAE | N,N—diisopropyl-2-aminoethanol |
| DDD | 4,7,-dioxadecane-1,10-diamine |

-continued

| | |
|---|---|
| DDDD | 4,9-dioxadodecane-1,12-diamine |
| EDA | ethylenediamine |
| LUB 5603 | a reaction product of polyisobutenylsuccinic anhydride and diethylethanolamine sold by the Lubrizol Corp. under the trade designation LUBRIZOL 5603 |
| MIPAE | monoisopropylaminoethanol |
| MOR | morpholine |
| MPA | 3-methoxypropylamine |
| SUR | an ethylene oxide adduct of a mixture of $C_{12}$–$C_{15}$ alcohols having an average molecular weight of 500 to 600 |
| TEA | triethanolamine |
| THICKENER | an associative polyether thickener having an average molecular weight of approximately 17000 prepared by reacting a mixture of ethylene oxide and propylene oxide (weight ratio of ethylene oxide to propylene oxide of approximately 85:15) to form a heteric intermediate, and then reacting the intermediate with a mixture of $C_{10}$–$C_{12}$ alpha-olefin epoxides such that the resulting epoxide-to-hydroxyl ratio was about 1.0:1.0 |
| TIPA | triisopropanolamine |
| TT | tolyltriazole (50 percent solution) |
| TTD | 4,7,10-trioxatridecane-1,13-diamine |
| ZDP | zinc dialkyldithiophosphate wherein all R groups are 2-ethylhexyl |

The following examples will illustrate the effect of using various primary amine compounds in a hydraulic fluid containing an antiwear additive and polyether thickener along with other components. The undiluted fluids were first formulated and then water was added so the total parts equaled 100 pbw.

The wear rates were determined by using the Vickers Vane Pump Test. The hydraulic circuit and equipment used were as specified in ASTM D2882 and D2271.

The Vickers Vane Pump Test procedure used herein specifically requires charging the system with 5 gallons of the test fluid and running at a temperature of 48.9° C. at 2000 psi pump discharge pressure (load) overnight (16 to 20 hours). Wear data were made by weighing the cam-ring and the vanes of the "pump cartridge" before and after the test.

Throughout the instant specification and claims, unless otherwise indicated, all parts and percentages are by weight and all temperatures are in degrees centigrade.

EXAMPLES

Comparsion Example 1

A diluted base fluid was prepared as above described having the composition of Table I which follows:

TABLE I

| Component | Amount (wt %) |
|---|---|
| MOR | 0.95 |
| LUB 5603 | 1.0 |
| MIPAE | 0.75 |
| SUR | 4.00 |
| TT | 0.15 |
| THICKENER | 5.00 |
| ZDP | 0.75 |
| Water q.v. | 100.00 |

The Vickers vane pump test was then run as set forth previously. The test was run six times and the average wear in mg/hr was calculated. The average wear rate for the base fluid was 8.5 mg/hour.

Examples 1–5

Examples 1–5, which are summarized in Table II, show the effect of replacing up to 0.25 part of water in the composition of Example 1 with various primary amines within the scope of the invention.

TABLE II

| Example | Primary Amine | Average Wear Rate (mg/hr) |
|---|---|---|
| 1 | TTD | 0.21 |
| 2 | DDD | 0.23 |
| 3 | DAP | 0.64 |
| 4 | MPA | 0.83 |
| 5 | DDDD | 3.0 |

Prereacted complexes of some of the primary amines shown in Table II with ZDP were also formed and tested as outlined before. The 0.75 ZDP of Table I was reacted with an amount of amine such that the atom ratio of nitrogen to zinc was about 2:1. The reaction product was added to the fluid in lieu of the ZDP of Table I. The results are shown in Table III.

TABLE III

| Example | Prereacted Complex of ZDP with | Average Wear Rate mg/hr. |
|---|---|---|
| 6 | TTD | 0.27 |
| 7 | MPA | 0.91 |
| 8 | DAP | 0.37 |

The results in Tables I, II, and III indicate that improved wear results if primary amines or complexes formed with primary amines within the scope of this invention are added to the base fluid.

Comparison Example 2

A diluted base fluid was prepared as above described having the composition of Table IV which follows:

TABLE IV

| Component | Amount (wt %) |
|---|---|
| DIPAE | 0.70 |
| SUR | 4.00 |
| TEA | 1.00 |
| THICKENER | 1.60 |
| ZDP | 0.75 |
| TT | 0.15 |
| Water q.v. | 100.00 |

The thickener was prepared the same as that for Comparison Example 1 with the exception that a mixture of $C_{15}$ to $C_{18}$ alpha-olefin epoxide was reacted with the intermediate in lieu of the $C_{10}$ to $C_{12}$ epoxide The Vickers vane pump test was then run as set forth previously except that the pressure was only 1000 psi for 500 hours. The test was run two times and the average wear in mg/hr was calculated. The average wear rate for the base fluid was 0.56 mg/hour.

Example 9

In Example 9, 0.5 part of water in Comparison Example 2 was replaced with 0.5 part TTD and tested with the Vickers vane pump for 500 hours as previously described. The average wear rate in mg/hr. was 0.03 mg/hr.

These results are particularly suprising in view of how the addition of some other amines affected the wear rate of the base fluid.

The amines of Table V below were tested as outlined before in Examples 1 to 5. These results are summarized in Table V.

TABLE V (Comparison Results)

| Amine | Average Wear rate mg/hr |
|---|---|
| EDA | 32.0 |
| BA | 23.0 |
| AP | 10.7 |
| CHA | 10.3 |

This data indicates that these amines adversely affected the wear of the fluid.

The embodiments of the invention in which an exclusive privilege or property is claimed are defined as follows:

1. A composition of matter which comprises

A. a zinc dialkyldithiophosphate selected from the group consisting of compounds having the following structural formulae:

$$Zn[(RO)_2PS_2]_2 \quad \text{(I)}$$

wherein each R is individually linear or branched alkyl, alkenyl, aryl, arylalkyl, or alkylaryl groups having from 3 to 24 carbon atoms;

$$Zn_4[(RO)_2]_6O, \quad \text{(II)}$$

wherein each R is individually a linear or branched alkyl, alkenyl, aryl, arylalkyl, or alkylaryl groups having from 3 to 24 carbon atoms and B. a primary amine compound selected from the group consisting of compounds having the following structural formula:

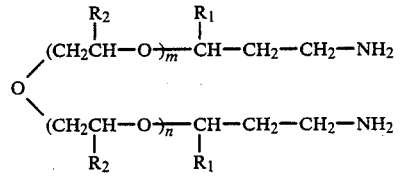

(III)

wherein m and n are both numbers from 0 to about 25 and m+n equals at least 1, and $R_1$ and R2 are independently selected from H and a lower alkyl group having from 1 to about 4 carbon atoms;

$$R\,(CH_2)n\,NH_2 \quad \text{(IV)}$$

where R is an alkoxy group, having 1 to 4 carbon atoms and is n is a whole number from 2 to 4;

$$R(OCH_2CH_2CH_2NH_2)_2 \quad \text{(V)}$$

where R is an alkylene group having from 2 to 8 carbon atoms; and $$H_2NRNH_2 \quad \text{(VI)}$$

wherein R is an alkylene group having from 3–4 carbon atoms; and wherein the weight ratio of A:B is about 1:0.1 to 1:5.

2. The composition of claim 1 wherein said zinc dialkyldithiophosphate is the compound of formula I.

3. The composition of claim 2 wherein the R's of formula I are 2-ethylhexyl.

4. The composition of claim 1 wherein said composition is the reaction product of amine (B) and zinc compound (A).

5. The composition of claim 2 wherein said composition is the reaction product of primary amine compound (B) and said zinc dialkyldithiophosphate of formula I.

6. The composition of claim 3 wherein said composition is the reaction product of primary amine compound (B) and said zinc di(2-ethylhexyl)dithiophosphate of formula I.

7. A functional fluid which comprises

A. a metal dialkyldithiophosphate selected from the group consisting of:

(I) $Zn[(RO)_2PS_2]_2$ wherein each R is individually linear or branched alkyl, alkenyl, aryl, arylalkyl, or alkylaryl groups having from 3 to 24 carbon atoms;

(II) $Zn_4[(RO)_2PS_2]_6O$, wherein each R is individually a linear or branched alkyl, alkenyl, aryl, arylalkyl, or alkylaryl groups having from 3 to 24 carbon atoms and B. a primary amine compound selected from the group consisting of compounds having the following structural formula:

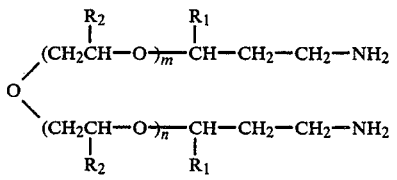

(III)

wherein m and n are both numbers from 0 to about 25 and m+n equals at least 1, and $R_1$ and R2 are independently selected from H and a lower alkyl group having from 1 to about 4 carbon atoms;

(IV) $R\ (CH_2)n\ NH_2$ where R is an alkoxy group, having 1 to 4 carbon atoms and is n is a whole number from 2 to 4;

(V) $R(OCH_2CH_2CH_2NH_2)_2$ where R is an alkylene group having from 2 to 8 carbon atoms; and (VI) $H_2NRNH_2$ wherein R is an alkylene group having from 3 to 4 carbon atoms; and wherein the weight ratio of A:B is about 1:0.1 to 1:5, and C. a functional fluid thickener.

8. The functional fluid of claim 7 including a carboxylic compound.

9. The functional fluid of claim 7 including a surfactant.

10. The functional fluid of claim 9 including a carboxylic compound.

11. The functional fluid of claim 10 wherein the metal dialkyldithiophosphate is the compound of formula I.

12. The functional fluid of claim 11 wherein said thickener is an associative polyether thickener prepared by reacting a conventional polyether polyol with an alpha-olefin epoxide having an average of from 6 to 24 total carbon atoms such that (1) the reaction is carried out in the presence of an oxyalkylation catalyst at a temperature of from about 50° C. to about 150° C.; and (2) an effective epoxide-to-hydroxyl ratio is used which will produce a thickener (a) which will have sufficient thickening efficiency to be used at less than ten percent weight concentration in an aqueous system; and (b) which will produce thickened aqueous systems that will flow in a Vickers 104(C) vane pump at 2000 psig.

13. The functional fluid of claim 11 wherein the surfactant is an ethylene oxide adduct of a mixture of $C_{12-15}$ alcohols such that the average molecular weight is from 300 to 5000.

14. The functional fluid of claim 11 wherein the Rs of formula 1 are 2-ethylhexyl.

15. The functional fluid of claim 7 employing the reaction product of primary amine (B) and metal dialkyldithiophosphate (A).

16. The functional fluid of claim 7 including a diluent selected from the group consisting of water and a freezing point lowering additive or mixture thereof to produce a finished fluid wherein, by weight of the finished fluid, about 60 to 99.9 percent is water, a freezing point lowering additive, or mixture thereof and about 1.0 to 15 percent is said functional fluid thickener.

17. The functional fluid of claim 16 including from about 0.1 to 5.0 percent of a carboxylic compound, said percentage being based upon the weight of the finished functional fluid.

18. The functional fluid of claim 16 including from about 0.5 to 10.0 percent of a surfactant, said percentage based upon the weight of the finished functional fluid.

19. The functional fluid of claim 18 including from about 0.1 to 5.0 percent of a phosphorus-free carboxylic compound, said percentage being based upon the weight of the finished functional fluid.

20. The functional fluid of claim 19 including a linear or branched alkanolamine in an amount of 0.5 to 5.0 parts by weight, based upon the weight of the finished functional fluid.

* * * * *